United States Patent [19]

Lajoie et al.

[11] 4,241,551

[45] Dec. 30, 1980

[54] BUILDING STRUCTURE

[76] Inventors: Marcel Lajoie, R.R. #1; Bernard Lajoie, R.R. #2, both of Sombra, Canada, N0P 2H0

[21] Appl. No.: 17,212

[22] Filed: Mar. 5, 1979

[51] Int. Cl.[3] ..... E04B 1/343

[52] U.S. Cl. ..... 52/90; 52/93; 52/122; 52/293; 52/745

[58] Field of Search ..... 52/90, 93, 79.5, 79.1, 52/125, 122, 143, 64, 293, 745, 66

[56] References Cited

U.S. PATENT DOCUMENTS

| | | | |
|---|---|---|---|
| 414,976 | 11/1889 | Harvey | 52/79.5 |
| 2,245,318 | 6/1941 | Blank | 52/143 |
| 2,482,918 | 9/1949 | Kump | 52/64 |
| 3,184,012 | 5/1965 | Fujishima | 52/293 |
| 4,035,965 | 7/1977 | Rowai | 52/143 |

*Primary Examiner*—John E. Murtagh

*Attorney, Agent, or Firm*—Hirons, Rogers & Scott

[57] ABSTRACT

A building structure is provided having a rectangular base frame, end wall panels sitting on the base frame along two opposite sides of the base frame, and roof-and-side panels resting on the other two sides of the base frame. The panels and sections are attached to one another by fasteners and coupling elements are used to attach at least some of the panels and sections to the base frame.

7 Claims, 13 Drawing Figures

28a
110
46
48
96
45

144
140
138
130
142
146

134
100
28a
132
46
140
130
45

26
28c
2
38
44
28b
34
28a
7
30c
30b
8
134
144
140
10
9
132
130
146
138
136
30a
142
36
62
24
20
22
45
32

42
40
34
32

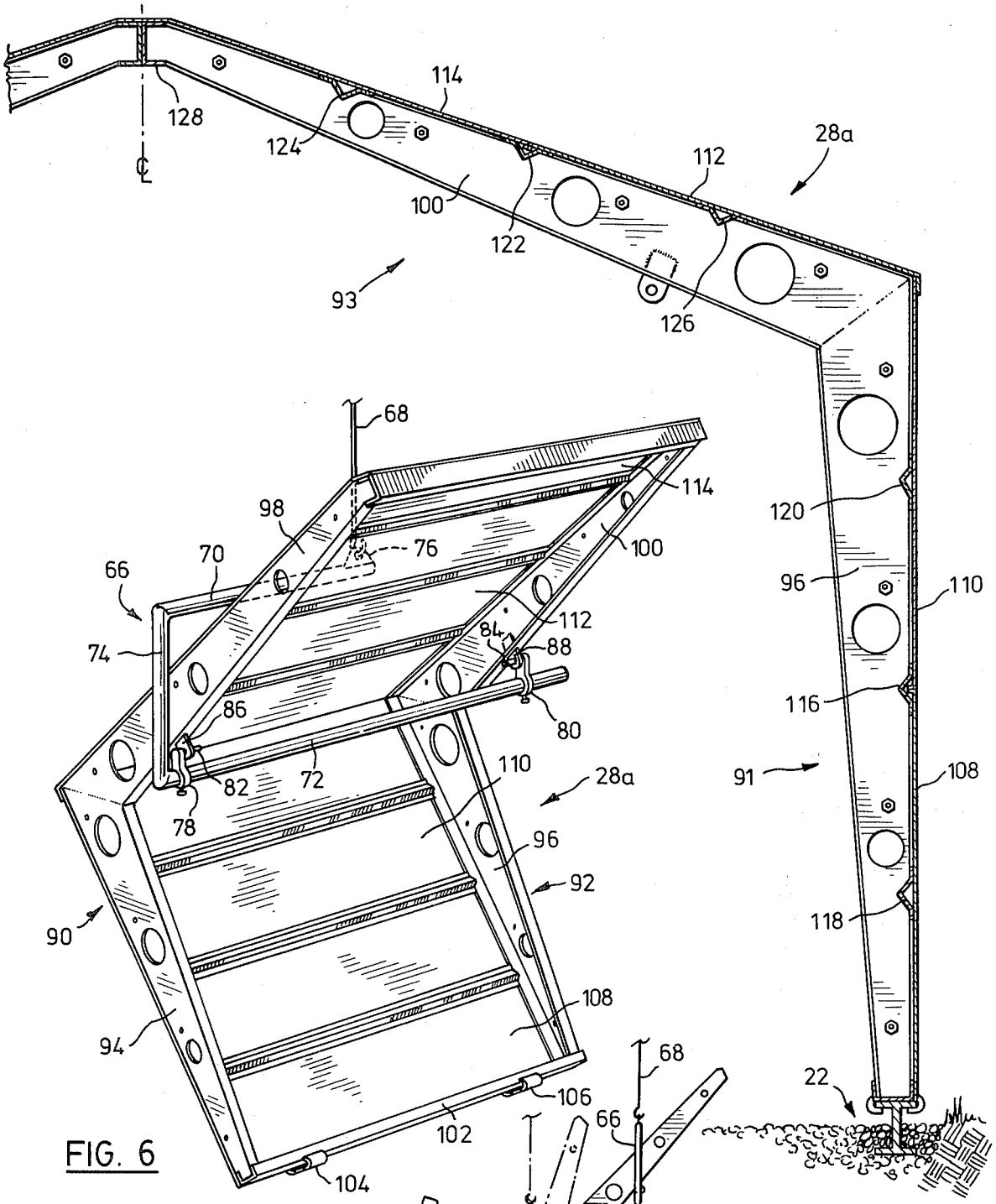
FIG. 6
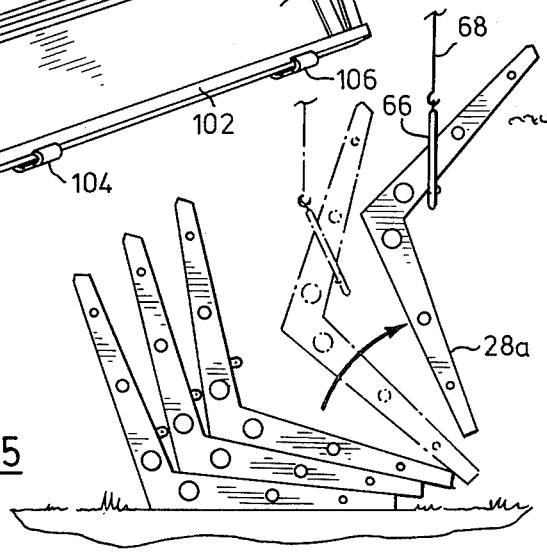
FIG. 7
FIG. 5

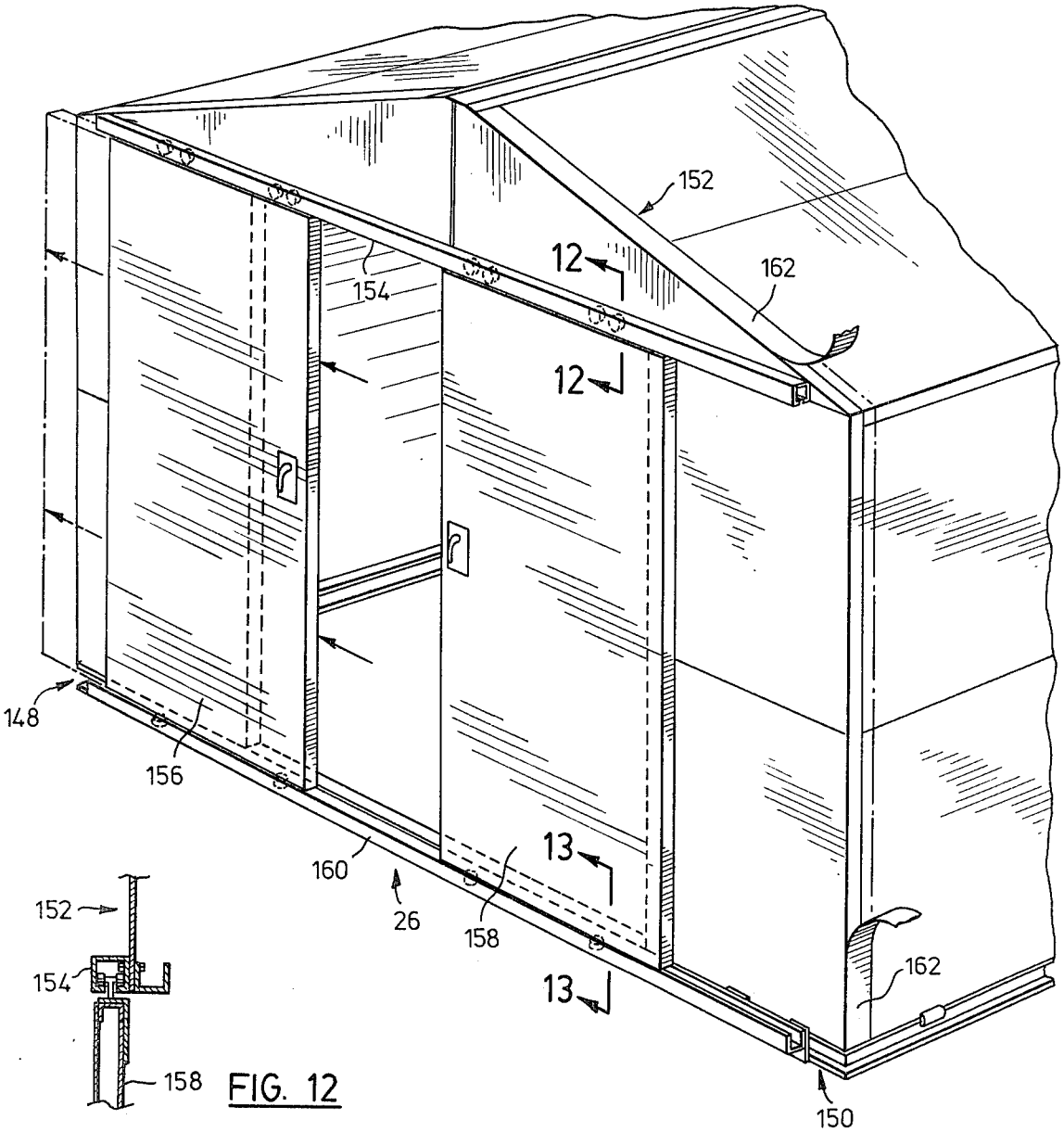
FIG. 11
FIG. 12
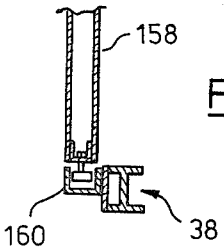
FIG. 13

BUILDING STRUCTURE

This invention is directed to a building structure of a type used primarily on construction sites where the structure must withstand constant abuse and yet be capable of rapid and efficient assembly and disassembly.

Building structures take many forms for different purposes. The present structure is intended to be used where efficient and rapid assembly is of great importance. An example of such use would be by plumbers, pipe fitters, and electricians who spend relatively short periods working on construction sites, in heavy plants and the like. These workers require a readily erected building on a level site to store materials and to use as a workshop. As soon as the job is completed the structure must be dismantled for erection on the next job site.

It is an object of the present invention to provide a robust building structure which is both readily assembled and readily dismantled.

Accordingly a building structure is provided having a base frame adapted to be placed on a level site, end walls, side walls, and a roof. Parts making up the walls are adapted to be interlocked with the base frame and releasably fastened to one another quite simply for ease of assembly and disassembly.

The invention will be better understood with reference to the drawings, in which:

FIG. 5 is a view to a reduced scale of a plurality of roof-and-side sections illustrating the stacking and lifting of these sections;

FIG. 6 is a perspective view of one of the sections being positioned in the building structure;

FIG. 7 is a sectional side view on the compound sectional line 7—7 shown in FIG. 1;

FIG. 11 is a perspective view of the opposite end of the building structure from that shown in FIG. 1 and illustrating a doorway in the structure;

FIG. 12 is a sectional side view on line 12—12 of FIG. 11; and

FIG. 13 is a sectional side view on line 13—13 of FIG. 11.

Figures 1, 2, 8, 9, 10:
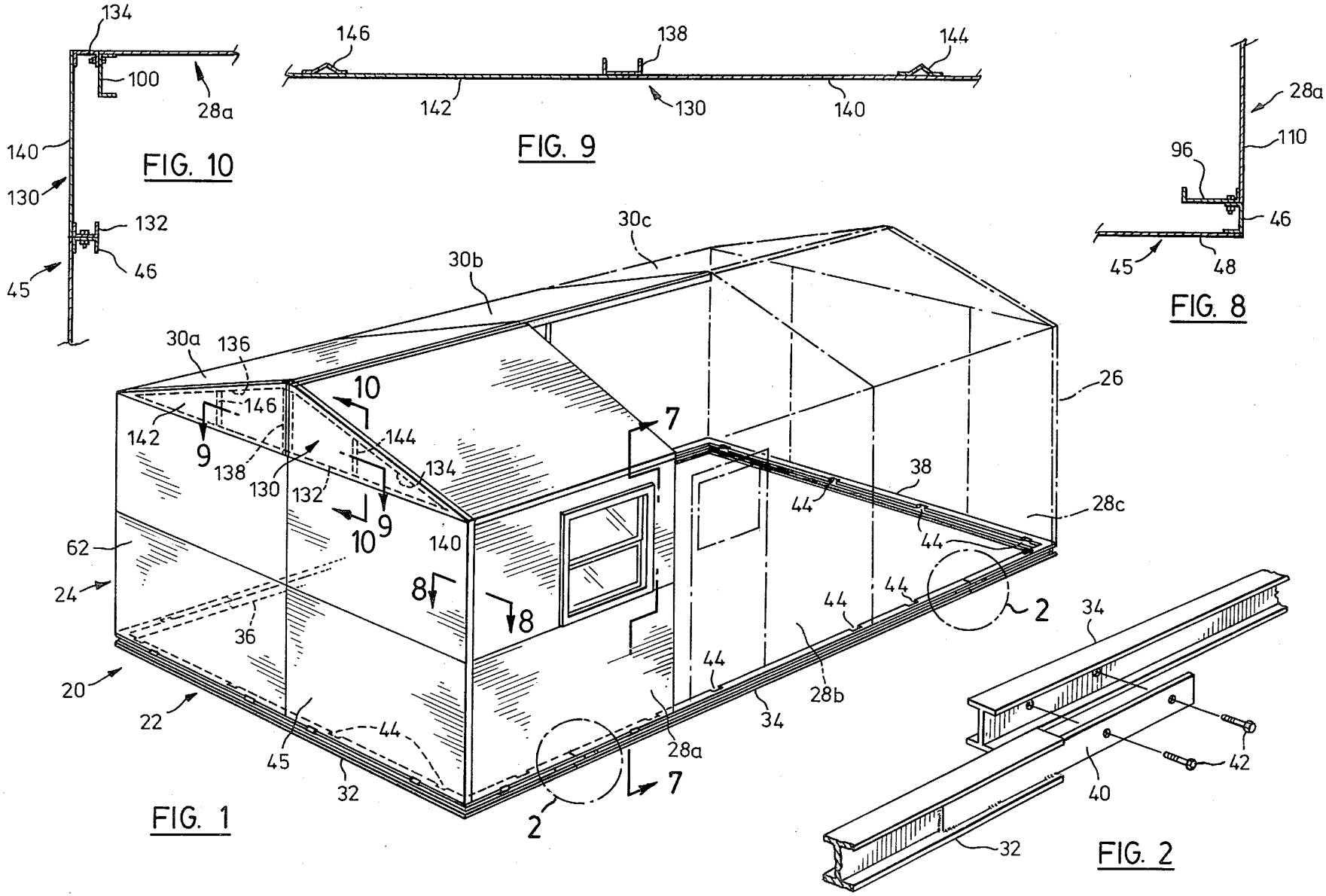
FIG. 1 is a perspective view of a partially erected building structure incorporating a preferred embodiment of the invention and indicating parts of the completed building structure in ghost outline.
FIG. 2 is an exploded perspective view of a part of the building structure indicated in FIG. 1 generally by the numeral 2.
FIG. 8 (drawn adjacent FIG. 1) is a sectional plan view on line 8—8 of FIG. 1.
FIG. 9 (drawn adjacent FIG. 1) is a sectional plan view on line 9—9.
FIG. 10 (drawn adjacent FIG. 1) is a sectional side view on line 10—10.

The building structure shown in the drawings illustrates a preferred embodiment in the sense that the preferred form of the various elements used to make the building structure are shown. However the building structure could be larger or smaller depending on the required length as will become apparent and consequently it should not be inferred that there is any preference for the size of the building structure shown in the drawings.

As seen in FIG. 1, a building structure is indicated generally by the numeral 20 and includes a peripheral base frame 22 supporting a first end wall 24, a second end wall 26, and roof-and-side sections 28*a*, 28*b*, 28*c*, 30*a*, 30*b*, and 30*c*. Each of these sections defines a part of one of the side walls together with a part of an apex roof.

The exemplary building structure shown in FIG. 1 will be described in detail before describing how various different sizes of building structure can be built. After introducing a part of the building structure, the assembly of this part will be described.

To commence assembly a site is cleared and a layer of crushed stone or gravel is then placed on the ground. The base frame is embedded to some extent in the gravel and levelled during assembly so that the completed base frame provides a level support for the rest of the building structure.

As seen in FIG. 1, the base frame 22 includes a generally U-shaped first end section 32, a pair of side sections 34, 36 and a U-shaped second end section 38. As better seen in FIG. 2 all of the sections forming the base frame are of an I-shaped cross-section. End section 32 has a pair of plates 40 attached one to each of its ends and these plates combine with fasteners 42 to couple the end section 32 to respective first ends of the side sections 34 and 36. Similarly, the other ends of the sections 34, 36 have plates attached and these plates combine with further fasteners to attach these side sections to the end section 38.

It will be seen in FIG. 1 that all of the sections forming the base frame define notches 44 in the upper and inner flange of the frame. The notches are used to facilitate assembly of the various wall sections on the base frame as will be described.

Figure 3:
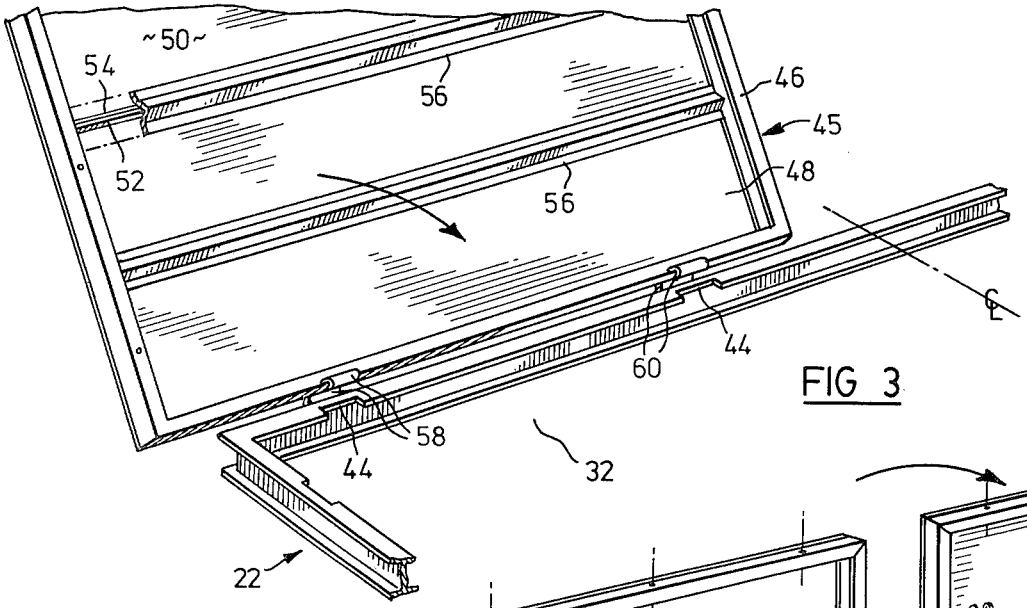
FIG. 3 is a perspective view of part of a base frame receiving a first end section during assembly of the building structure.

Reference is next made to FIG. 3 which illustrates end section 32 of the base frame 22 about to receive a first end wall panel 45 of the wall 24 (FIG. 1). The panel 45 is reinforced by a peripheral frame 46 made up of rolled channel sections and having two steel sheets 48, 50 attached to the outer surfaces of the frame 46. The sheets 48 and 50 meet at inwardly turned flanges 52, 54 which are spot welded to one another. The structure is further rigidified by three stiffeners 56 (two of which are seen in FIG. 3) and the centre one of which is attached to both sheets 48, 50 about the flanges 52, 54. The stiffeners 56 are also spot welded to the sheets 48, 50.

Figure 4:
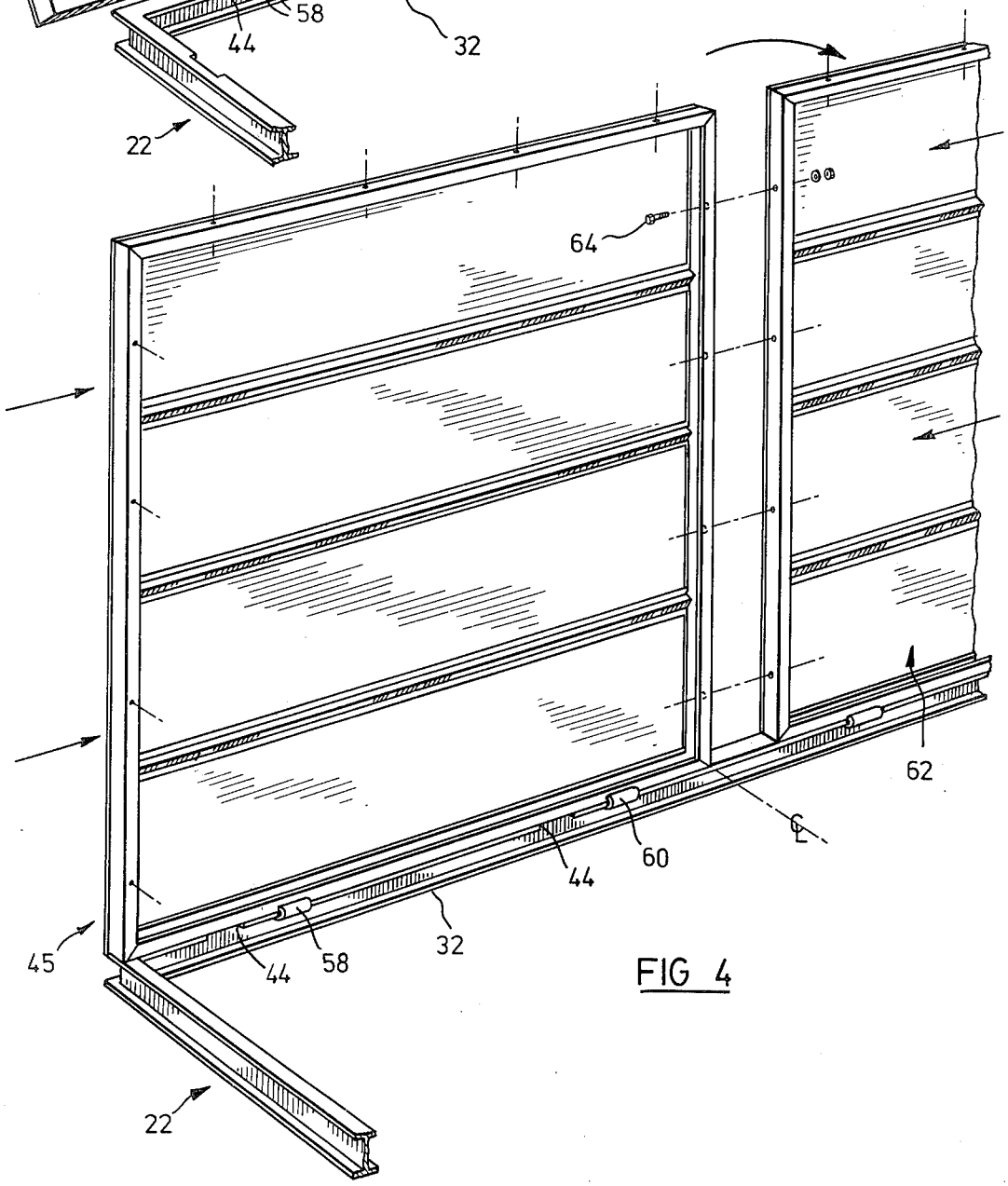
FIG. 4 is a view similar to FIG. 3 showing the first end section assembled and a second end section being positioned on the base frame.

The end wall panel 45 also inclues two pairs of C-shaped coupling elements 58, 60 welded to the bottom of the peripheral frame 46. These elements extend in pairs below the bottom of the frame 46 and are spaced apart to encompass the top flange of the end portion 32 of the base frame. The elements of each pair combine to define a mouth which is too small to receive the top flanges. Assembly is expedited by positioning the end wall panel 45 with the outermost coupling elements hooked under the outer of the top flanges and then tipping the panel 45 towards a vertical position so that the innermost of the coupling elements will pass through the notches 44 bringing the bottom of the peripheral frame 46 into face-to-face engagement with the top of the base frame 22. In this position the wall panel 45 projects sideways beyond the side of the base frame. The panel is located finally by sliding it along the base frame guided by the coupling elements 58, 60 into the position shown in FIG. 4. The end wall panel 45 is then retained in position by the coupling elements in a manner similar to that illustrated for a roof-and-side section 28*a* at the foot of FIG. 7.

Returning now to FIG. 4, a second end wall panel 62 is assembled on the end portion 32 of the base frame 22 in a similar fashion to that described with reference to wall panel 45 so that these panels can be attached to one another using four fasteners 64 (one of which is shown). For safety it may be preferable to use a suitable prop to retain the panels in an upright condition at this stage.

Reference is next made to FIG. 5 which illustrates a series of roof-and-side sections such as those described with reference to FIG. 1 to a smaller scale. Some of these sections are stacked while this figure also shows how the sections would be lifted off the stack. It will be evident that the sections can be stacked in this manner for storage and transportation thereby limiting storage space requirements.

FIGS. 5 and 6 illustrate the roof-and-side section 28*a* coupled to a lifting element 66 which is in turn releasably attached to a cable 68 of a suitable light crane or the like. It will be seen in FIG. 6 that the lifting element 66 consists of upper and lower arms 70, 72 integrally attached to a connecting portion 74. The arm 70 is slightly longer than half the width of the section 28*a* and terminates at a lifting eye 76 to facilitate attachment to the cable 68. The lower arm 72 carries a pair of opposed connectors 78, 80 which include respective pins 82, 84 for engagement in lugs 86, 88 on the section 28*a*. The connectors 78, 80 are adjustable on the arm 72 it would normally only be necessary to move one of these connectors in order to engage and disengage the lifting element 66 on the section 28*a*.

It should be noted that the pins 82, 84 of the lifting elements 78, 80 are free to rotate in the respective lugs 86, 88 so that the section 28*a* can pivot with respect to the lifting element 66. Returning to FIG. 5, it will be evident that as the lifting commences there will be a pivoting action until the section 28*a* takes up a position shown to the right of FIG. 5 and dictated by the placement of lugs 86, 88 relative to the centre of gravity of the section. Section 28*a* is then in the correct position for assembly as will be described after more description of section 28*a*.

As seen in FIGS. 6 and 7, the section 28*a* which is typical of all of the other sections shown in FIG. 1 defines a side wall part 91 and a roof part 93. Two strong side elements 90, 92 (which are mirror images of one another) have respective lower segments 94, 96 associated with the side wall part 91 and upper segments 98, 100 associated with the roof part 93 of the section. The segments of each pair lie at an angle to one another defined by the required apex of the roof.

Segments 94, 96, 98 and 100 are broadest at the junction between segments and narrowest furthest away from this junction. This tapering provides structural rigidity which is enchanced by the general U-shaped cross-section of the segment.

The section 28*a* terminates at its bottom periphery in a channel element 102 to which 2 pairs of coupling elements 104, 106 are attached. As seen in FIG. 7, these elements are coupled to the base frame in a similar manner to that described with reference to the elements on the end wall panel 45 shown in FIG. 3.

The side elements 90, 92 support 4 standard 8 feet by 4 feet metal sheets 108, 110, 112, and 114. As better seen in FIG. 7, the sheets 108, 110 meet at flanges contained within an internal stiffener 116 in a similar fashion to that described with reference to the stiffener 56 shown in FIG. 3. A stiffener 118 is provided centrally on the sheet 108 and a further stiffener 120 is provided on the sheet 110.

The sheets 112, 114 which extend between the upper segments 98, 100 of the section 28*a* also meet at inturned flanges where they are spot welded to one another and these flanges are contained within a stiffener 122. Further stiffeners 124 and 126 are provided and it will be noted that the sheet 112 is turned downwardly over the upper extremity of the sheet 110 where the two sheets are spot welded to one another to direct water draining off the roof down the wall rather than into the building structure. At its upper extremity, the sheet 114 is wrapped over a top channel element 128 which is adapted to be engaged in back-to-back relationship with an element of an opposite section so that these elements can be attached to one another using suitable fasteners (not shown). Similarly, the section 28*a* is attached to an adjacent section using four fasteners in each of the segments 94, 96, 98 and 100.

Returning to a description of the assembly of the section 28*a*, after lifting this section as shown in FIG. 5 and FIG. 6, the section is positioned on the base frame with the outermost of the coupling elements 104, 106 engaged under the outermost top flange of the base frame and with the section 28*a* spaced slightly away from the end wall panel 45. The innermost of the elements 104, 106 are aligned with notches in the base frame and then using the lifting equipment associated with cable 68, the section 28*a* is tilted to bring the wall part of the section into an upright condition. The innermost of the coupling elements then passes through the associated notches and the underside of the channel element 102 comes into face-to-face relationship with the top of the base frame 22. Next the side-and-roof section 28*a* is slid on the base frame towards the end wall panel 45 where it can be attached to this panel using four fasteners in a similar fashion to that described for fastening the panel 45 to the panel 62 (FIG. 4) and as shown in FIG. 8.

After the side of roof section 28*a* has been attached to the panel 45 (FIG. 1), the side-and-roof panel 38*a* is assembled and attached to the panel 62. Any prop that has been used to retain the panels 45, 62 in an upright condition can now be removed and a gable panel 130 is positioned to rest on the panels 45, 62 in engagement with the sections 28*a*, 30*a*.

The gable panel 130 is proportioned to lie between the upper extremities of the panels 45 and 62 and the planes of the apex roof. As seen in FIGS. 1, 9 and 10 the panel 130 includes a lower peripheral element 132 for attachment to peripheral frame 46 of panel 45 and to a corresponding frame of panel 62. Two upper elements 134, 136 are inclined to extend from ends of element 132 to meet at the apex of the roof and at the top of a strengthening piece 138. This piece also forms an attachment surface for triangular sheets 140, 142 which are spot welded to this piece and to the elements 132, 134 and 136. Stiffeners 144, 146 are provided on the respective sheets 140, 142.

Assembly of the building is continued by adding side-and-roof sections 28*b*, 28*c*, 30*b*, 30*c*. As shown in the drawing these panels can vary slightly from one another by the inclusion of a window or a door. Otherwise the panels are similar and interchangeable. After assembling all six of the side-and-roof sections, the other end wall 26 is assembled. As seen in FIG. 11, this end wall includes two sliding doors for ease of access to store equipment.

As seen in FIGS. 11, 12 and 13, the end wall 26 is made up of two smaller end wall panels 148, 150 which are of similar construction to panels 45, 62 (FIG. 1). Also a gable panel 152 is similar to gable panel 130 but panel 152 has a track 154 attached for receiving door hanger equipment for sliding doors 156, 158. A bottom track 160 is also provided. The doors and associated hardware are conventional.

FIG. 11 also illustrates how the building structure is weatherproofed. An adhesive tape 162 is applied over all of the joints and especially those where rain could enter. This tape is sold by the 3M Company and is a polyvinylchloride tape designated no. 471.

It will be evident that the preferred form of the parts of the building structure can be used to make buildings of various sizes and with different window and access arrangements. Longer buildings will require more side portions and roof-and-side sections.

The resulting structure is readily dismantled and because of the relatively small number of parts in the structure there is little possibility of losing important parts or finding it difficult to understand how to assemble the structure.

In some instances it may be preferable to use a flat roof or more generally a roof which is built up separately on top of the side and end walls. It will be evident that this can be done by using panels for side walls in a similar fashion to those used for end wall 24 with suitable strengthening to support a separate roof. Such a structure could still take advantage of the simple connection between the side and end walls and the base frame 22.

A further possible structural variation is to form notches 44 (FIG. 1) of the base frame 22 in the outer top flange rather than in the inner flange as shown. The inner flange is preferred both for appearance and to make use of the convenient lifting system for the roof and side sections described with reference to FIGS. 5 and 6.

What we claim as our invention is:

1. A building structure comprising:

a base frame adapted to defining a rectangle in plan view after assembly, the base frame including coplanar inner and outer top flanges which on assembly define a horizontal top surface, one of the flanges defining notches;

end wall panels adapted to stand on parts of the top surface defined by two of the sides of the rectangular base frame;

side wall parts adapted to stand on parts of the top surface defined by the other sides of the rectangular base frame;

roof parts adapted to be supported by the side wall parts on assembly;

means adapted to couple the end wall panels, side wall parts and roof parts to one another to rigidify the structure on assembly;

and coupling elements attached in pairs to at least some of the end wall panels and the side wall parts, each pair of elements extending downwardly and attached one to the inside and one to the outside of the associated one of said panels or side wall parts, the elements being generally C-shaped and curving downwardly and towards one another for respective engagement under said inner and outer top flanges of the base frame, the notches in the base frame and the coupling elements being proportioned and positioned to permit assembly by passing one of the C-shaped elements through the notch in said one of the flanges with the other element hooked under the other of the flanges and then sliding the associated one of the end wall panels and side wall parts along the base frame into final assembled positions.

2. A building structure as claimed in claim 1 in which the side wall parts and the roof parts are integrally attached to one another in pairs to provide roof-and-side sections.

3. A building structure as claimed in claim 2 in which the roof part of at least one of the roof-and-side sections includes attachment means to facilitate lifting the roof-and-side section such that when the section is suspended the side wall part lies at an angle to the vertical to facilitate connecting the associated ones of the coupling elements to the base frame.

4. A building structure as claimed in claim 2 in which the roof-and-side sections include side elements each of which includes a lower segment bordering an edge of the associated side wall part and an upper segment bordering the edge of the associated roof part, the segment being tapered to a maximum width where they meet at the junction of the side wall and roof parts.

5. A building structure as claimed in claim 4 in which said coupling means includes fasteners adapted to fasten adjacent side elements to one another.

6. A building structure comprising:

a base frame adapted to defining a rectangle in plan view after assembly, the base frame including coplanar inner and outer top flanges which on assembly define a horizontal top surface, one of the flanges defining notches;

end wall panels adapted to stand on parts of the top surface defined by two of the sides of the rectangular base frame;

roof-and-side sections each of which includes a side wall part and a roof part lying at an angle to the side wall part, the angle being dictated by the desired shape of the apex roof, the roof-and-side sections being adapted to stand on parts of said top surface defined by the other two sides of the rectangular base frame with each of the roof-and-side sections meeting another of these sections at the apex of the roof;

side wall parts adapted to stand on parts of the top surface defined by the other sides of the rectangular base frame;

means adapted to couple the end wall panels and roof-and-side sections to one another to rigidify the structure on assembly;

and coupling elements attached in pairs to at least some of the end wall panels and the roof-and-side sections, each pair of elements extending downwardly and attached one to the inside and one to the outside of the associated one of said panels or roof-and-side sections, the elements being generally C-shaped and curving downwardly and towards one another for respective engagement under said inner and outer top flanges of the base frame, the notches in the base frame and the coupling elements being proportioned and positioned to permit assembly by passing one of the C-shaped elements through the notch in said one of the flanges with the other element hooked under the other of the flanges and then sliding the associated one of the end wall panels and roof-and-side sections along the base frame into final assembled position.

7. A method of making a building structure comprising the steps:

laying a plurality of parts on a levelled area to form a rectangular base frame having coplanar inner and outer top flanges which define a horizontal top surface, one of the flanges defining notches;

placing side wall parts on parts of the top surface defined by the other sides of the rectangular base frame, the side wall parts having coupling elements attached in pairs to at least some of the side wall parts, each pair of elements extending downwardly and attached one to the inside and one to the outside of the associated one of said panels or side wall parts, the elements being generally C-shaped and curving downwardly and towards one another for respective engagement under said inner and outer top flanges of the base frame, the notches in the base frame and the coupling elements being proportioned and positioned so that during assembly one of the C-shaped elements is passed through the notch in said one of the flanges while rotating the side wall part into a vertical position and with the other element hooked under the other of the flanges, the associated one of the end wall panels is then slid along the base frame into a final assembled position;

placing end wall panels on parts of the top surface defined by two of the sides of the rectangular base frame;

adding roof parts to tops of the side wall parts; and coupling the end wall panels, side wall parts and roof parts to one another to rigidify the structure on assembly.

* * * * *